US008278574B2

(12) United States Patent
Grimm

(10) Patent No.: US 8,278,574 B2
(45) Date of Patent: Oct. 2, 2012

(54) SWITCH ELEMENT FOR A MOVABLE FURNITURE PART

(75) Inventor: Mathias Grimm, Altach (AT)

(73) Assignee: Julius Blum GmbH, Hoechst (AU)

( * ) Notice: Subject to any disclaimer, the term of this patent is extended or adjusted under 35 U.S.C. 154(b) by 294 days.

(21) Appl. No.: 12/621,898

(22) Filed: Nov. 19, 2009

(65) Prior Publication Data

US 2010/0066274 A1 Mar. 18, 2010

Related U.S. Application Data

(63) Continuation of application No. PCT/AT2008/000171, filed on May 15, 2008.

(30) Foreign Application Priority Data

May 24, 2007 (AT) ..... GM334/2007

(51) Int. Cl.
*H01H 13/18* (2006.01)
*H01H 13/64* (2006.01)

(52) U.S. Cl. ..... 200/18; 200/5 B; 200/341

(58) Field of Classification Search ..... 200/1 B, 200/5 B, 310, 329, 341, 302.1–302.3, 1 R, 200/342, 344, 18; 312/319.8, 330.1, 215
See application file for complete search history.

(56) References Cited

U.S. PATENT DOCUMENTS

| | | | | |
|---|---|---|---|---|
| 2,489,185 | A * | 11/1949 | Johnson | 200/16 A |
| 2,899,511 | A | 8/1959 | Fraser | |
| 2,927,988 | A | 3/1960 | Powell | |
| 4,300,025 | A | 11/1981 | Prada | |
| 5,665,947 | A * | 9/1997 | Falcon | 200/61.18 |
| 5,887,446 | A | 3/1999 | Lee | |
| 5,938,589 | A * | 8/1999 | Wako et al. | 600/159 |
| 6,972,385 | B2 * | 12/2005 | Krebs et al. | 200/1 B |
| 7,282,657 | B2 * | 10/2007 | Wimmer et al. | 200/302.2 |
| 7,375,300 | B2 * | 5/2008 | Pedersen et al. | 200/341 |
| 7,560,653 | B1 * | 7/2009 | Sage | 200/302.1 |
| 2001/0013745 | A1 | 8/2001 | Fulterer et al. | |
| 2005/0034966 | A1 | 2/2005 | Krebs et al. | |
| 2008/0122332 | A1 | 5/2008 | Brustle | |

FOREIGN PATENT DOCUMENTS

| | | |
|---|---|---|
| DE | 88 10 036 | 1/1989 |
| DE | 100 23 199 | 1/2001 |
| DE | 20 2006 000 535 | 4/2006 |
| DE | 10 2005 046 621 | 1/2007 |
| EP | 0 702 384 | 3/1996 |

(Continued)

OTHER PUBLICATIONS

International Search Report issued Apr. 9, 2009 in International (PCT) Application No. PCT/AT2008/000171.

(Continued)

*Primary Examiner* — Eduardo Colon Santana
(74) *Attorney, Agent, or Firm* — Wenderoth, Lind & Ponack, L.L.P.

(57) ABSTRACT

The invention relates to a switch element including an actuating element that can be impinged upon by an energy accumulator (force storage device) and is mounted so that it can be moved along a trajectory. At least two energy accumulators are used to impinge the actuating element and the number of the energy accumulators impinging the actuating element varies in predetermined positions of the trajectory.

15 Claims, 10 Drawing Sheets

FOREIGN PATENT DOCUMENTS

| | | |
|---|---|---|
| EP | 1 125 525 | 8/2001 |
| EP | 1 496 529 | 1/2005 |
| JP | 10-208579 | 8/1998 |
| WO | 2006/099645 | 9/2006 |

OTHER PUBLICATIONS

Austrian Search Report issued Mar. 12, 2008 in Austrian Application No. GM 334/2007.

* cited by examiner

SWITCH ELEMENT FOR A MOVABLE FURNITURE PART

This application is a continuation application of International application PCT/AT2008/000171, filed May 15, 2008, the entire disclosure of which is incorporated herein by reference.

BACKGROUND OF THE INVENTION

The present invention concerns a switch element comprising an actuating element which can be acted upon by a force storage means (energy accumulator) and which is mounted movably over a predetermined path, a drive device for a movable furniture part having a control or regulating device (collectively a control device) and an article of furniture comprising a movable furniture part and such a drive device.

Such switch elements are used for example in such a way that in its closed position, the movable furniture part bears against the actuating element, whereby the application of a pulling or pushing force to the furniture part by a user results in a movement of the actuating element.

It is known, for example, for the force storage means to be in the form of a compression spring and for the actuating element to be arranged relative to the force storage means in such a way that, with a furniture part in the closed position, the actuating element is pressed in against the force of the compression spring by the furniture part bearing against the actuating element, over a part of the overall predetermined path. If now a user applies pressure to the furniture part in the closed position (it will be appreciated that a suitable play for the movement of the furniture part also has to be provided in the closed position of the furniture part), the actuating element is further moved against the force applied by the compression spring. That can be detected either by a sensor device for monitoring the movement of the actuating element or by way of suitably arranged switches, whereupon triggering of a drive device for the furniture part takes place.

In contrast, the user might apply a pulling force to the furniture part in the closed position. If therefore, for example, he moves a drawer out of the furniture body somewhat or if he lifts a flap away from the furniture body somewhat, the result of this is that the actuating element, by virtue of the force applied by the compression spring, follows the furniture part over a portion of the predetermined path, which can also be detected by a sensor device for monitoring the movement of the actuating element or suitable switches and can be used for triggering a drive device of the furniture part.

A disadvantage with such a conventional switch element is the fact that the neutral position (no triggering of the drive device) of the actuating element in which the furniture part is disposed in the closed position thereof is relatively poorly defined and can be on the characteristic curve of the force storage means everywhere over the predetermined path. That also involves reduced operating comfort and convenience as most users will find it agreeable if the switch element can be triggered at a precisely defined switching point.

SUMMARY OF THE INVENTION

The object of the invention is to develop a switch element of the general kind set forth, in such a way that the above-discussed disadvantages are overcome. That object is attained by a switch element having the features described below.

The desired switching points can be pre-defined by in-factory selection of the predetermined positions along the path over which the actuating element can move. In that respect, it may be sufficient to provide only two force storage means (energy accumulators) so that only one predetermined position and thus a single defined switching point is implemented within the path over which the actuating element can move.

A switch element according to the invention can be used for example in a drive device for a movable furniture part, the control or regulating device (collectively referred to as a control device) of the drive device being connected to an interface or electric lines of the switch element. In that respect, the term interface is to be interpreted broadly. By way of example it is also possible to provide for wireless signal transmission by radio or infrared.

A particularly preferred embodiment concerns a drive device for a movable furniture part, comprising a control or regulating device connected to an interface or electric lines of a switch element, and an electric motor triggerable by the control or regulating device for driving the furniture part. The switch element has an actuating element which is mounted movably along a path and which can be acted upon by a force storage means having a characteristic curve. The switch element triggers the electric motor by way of the control or regulating device by movement of the actuating element at a switching point. There are provided at least two force storage means for acting on the actuating element, and the number of force storage means acting on the actuating element changes at predetermined positions on the path (S). The gradient of the characteristic curve changes at those positions, of which positions a position within the path is in the form of a switching point of the switch element.

Such a drive device is suitable in particular for use in an article of furniture in which the furniture part in the closed position thereof bears against the actuating element of the switch element, thereby affording the possibility of triggering the drive device of the furniture part by pushing in the furniture part to the defined switching point or by pulling on the furniture part.

Further advantageous embodiments of the invention are defined in the appendant claims.

BRIEF DESCRIPTION OF THE DRAWINGS

The invention will be described in greater detail hereinafter with reference to the accompanying Figures in which.

DETAILED DESCRIPTION OF THE INVENTION

Figure 1C:
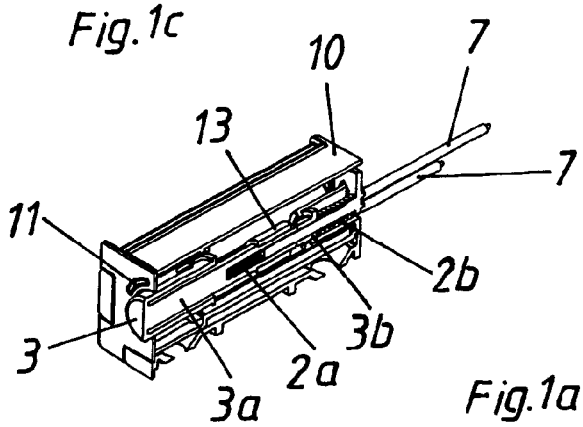
FIGS. 1*a* through 1*c* and 2*a* through 2*c* show a first embodiment of a switch element according to the invention.

The invention makes use of the fact that, in the arrangement of at least two force storage means (energy accumulators) 2*a*, 2*b* for acting on the actuating element 3, it is possible to establish a defined switching point for the switch element 1 by predetermining a position $S_2$, by altering the number of force storage means 2*a*, 2*b* acting on the actuating element.

A first position $S_1$ is for example at the beginning of the distance or path S which can be covered by the actuating element 3 (i.e., the position at which the actuating element 3 is fully extended and is not acted upon by any of the force storage means 2*a*, 2*b*). It will be noted, however, that that position $S_1$ is generally of subordinate significance for the invention as, in the mounted condition of the switch element 1 in or on an article of furniture, the furniture part 8 is in that case outside its closed position. For example, that position is adopted by the actuating element 3 when the furniture part 8 has been lifted off the furniture body or carcass by a user and then moved further away from the furniture body by a drive device 9. The actuating element 3 remains in that position $S_1$ until the furniture part 8 comes to bear against the actuating element 3 again. It will be noted, however, that in that case the furniture part 8 usually involves such a great momentum that it moves either of its own accord or by the force applied by a pull-in device, into the closed position, so that the user generally does not further notice the first defined switching point at position $S_1$.

It will be noted, however, that this is different if it is provided that the drive device 9 for the furniture part 8 also remains triggerable by the switch element 1 when the furniture part 8 is out of its closed position. That is particularly appropriate, for example, when the furniture part 8 is in the form of a flap as an opened flap and is disposed at a relatively high position and it may be more comfortable for a user to trigger closure of the furniture part by actuation of the actuating element 3 of the switch element 1.

It will be noted, however, that an aspect of greater significance is that defined switching point which is implemented at the position $S_2$ on the path S, by the number of force storage means 2*a*, 2*b* which act on the actuating element 3 being increased from one to two. In other words, in this embodiment, it is provided that between the positions $S_1$ and $S_2$ the actuating element 3 is acted upon only by the first force storage means 2*a* to resist being pushed in, and it is only at position $S_2$ that the second force storage means 2*b* also acts on the actuating element 3.

Preferably it is provided in that respect that the first force storage means 2*a* has already reached its maximum force at the position $S_2$. If the force storage means is for example in the form of a compression spring, that means that the compression spring cannot be further compressed in that position so that the force exerted by the force storage means 2*a* remains constant from that position.

Figure 6B:
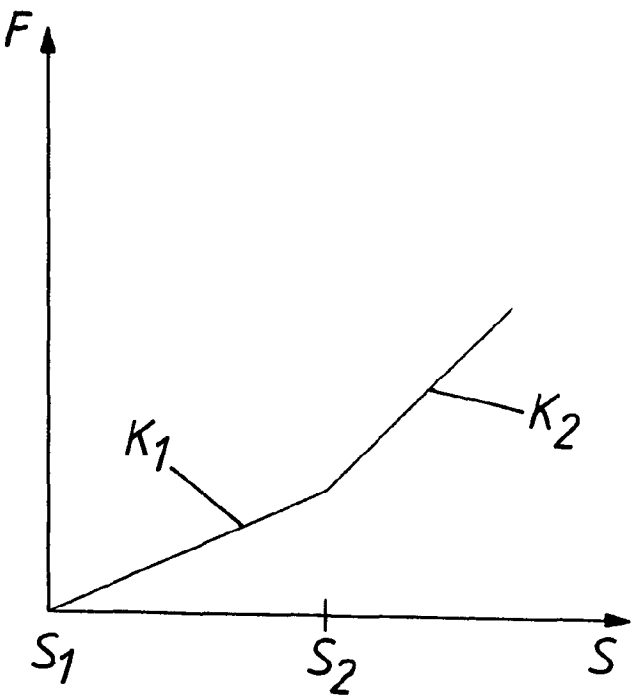
FIGS. 6*a* and 6*b* show by way of example the variation in force acting on the actuating element over the predetermined path when there are provided precisely two force storage means, for two different configurations.
Figure 6A:
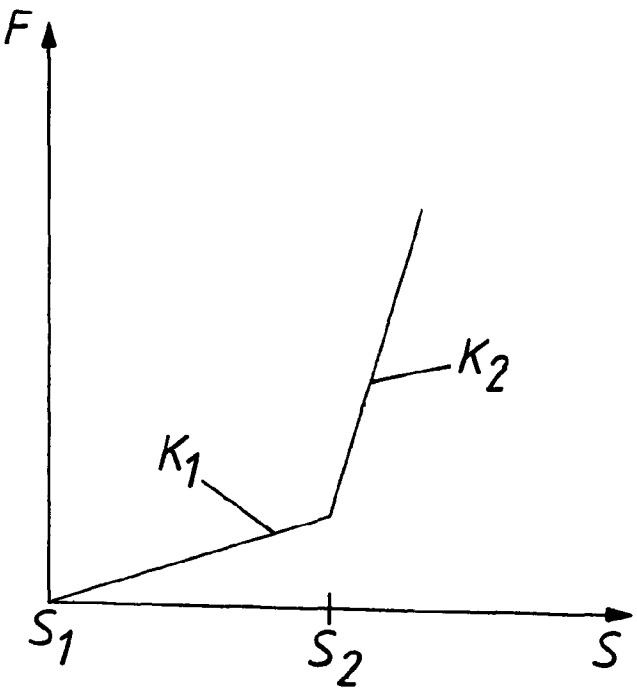
Figure 7:
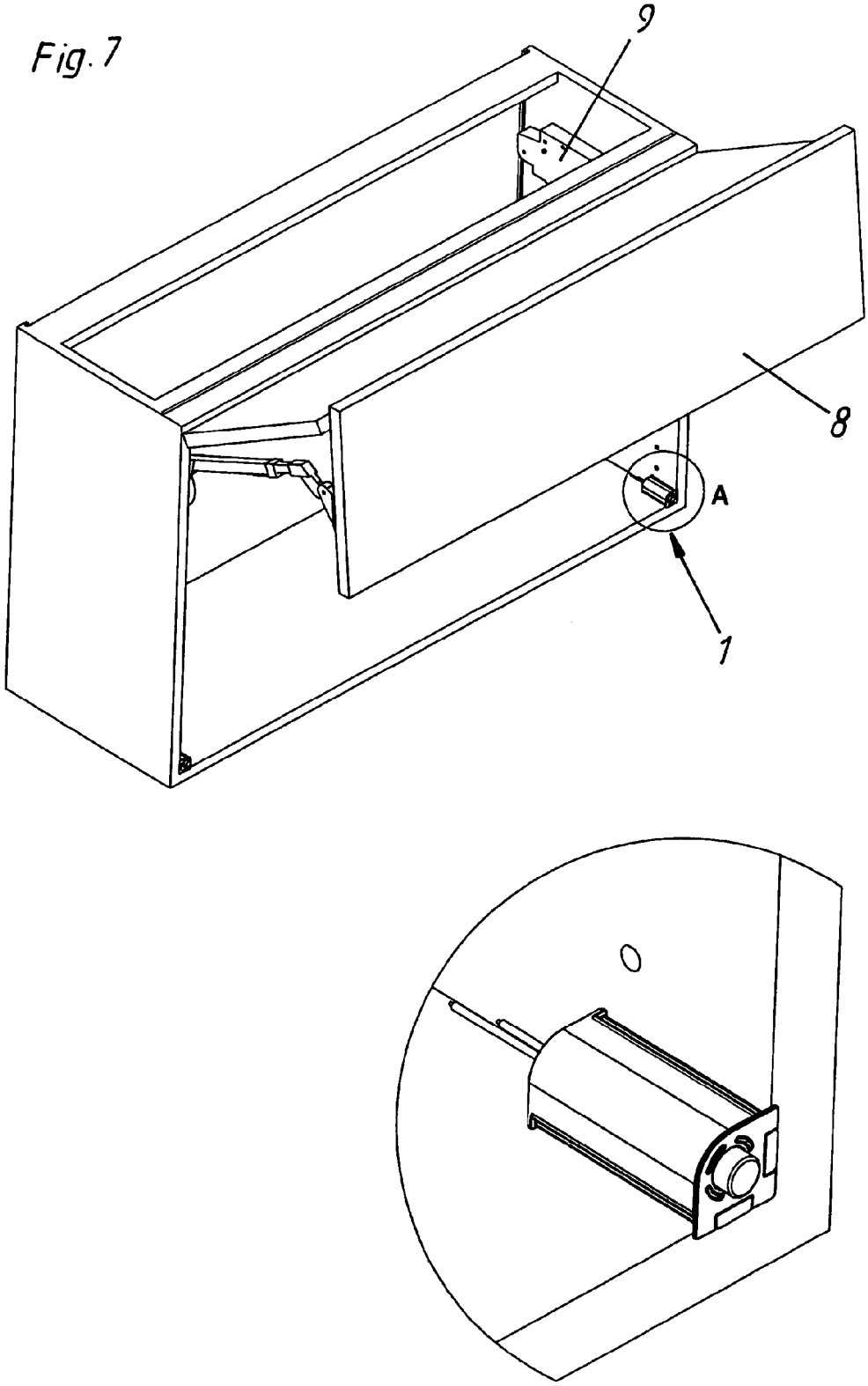
FIG. 7 shows an article of furniture comprising a drive device and a switch element according to the invention.

If the at least two force storage means 2*a*, 2*b* have force characteristic curves of differing gradients (that is to say the force F exerted by them plotted against the path S), that affords the defined switching point as the intersection point of the force characteristic curves of the force storage means 2*a*, 2*b* at the position $S_2$ (see FIGS. 6*a* and 6*b*).

A particularly simple structure for the switch element 1 is afforded if it is provided that the actuating element 3 has at least two portions 3*a*, 3*b* which are mounted limitedly movably relative to each other, as is shown by way of example in FIGS. 1 through 5.

In both cases, a respective one of the at least two force storage means 2*a*, 2*b* (which here are in the form of springs) is arranged between a mounting location 4, 5 and one of the at least two portions 3*a*, 3*b*.

As already stated, it may be advantageous if the at least two force storage means 2*a*, 2*b* have characteristic curves of differing gradients. In that way, it is possible for the one force storage means 2*a*, for example, to be made very much weaker than the other force storage means 2*b*. It will be appreciated, however, that it would also be conceivable for both force storage means 2*a*, 2*b* to be designed with the same characteristic curve (in the case of springs, that would mean with the same spring constant).

Two examples of possible structural configurations of the switch element 1 according to the invention will now be discussed in detail with reference to FIGS. 1 through 5.

Figure 1A:
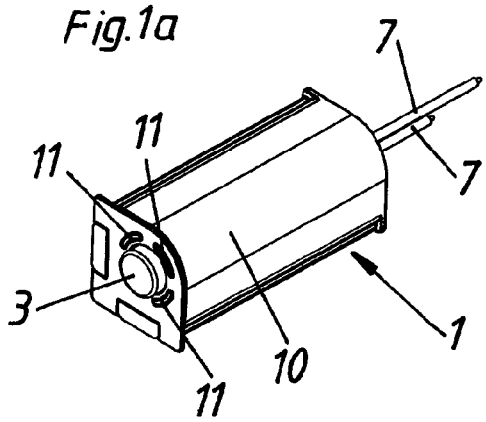

It is possible to see in FIG. 1*a* a switch element 1 according to the invention, from which extend electric lines 7 (electric connection) for the power supply to the switch element 1 and for transmitting the signals from the switch element 1. In this embodiment, the switch element 1 has a housing 10 and can be mounted for example in a corner of the furniture body of an article of furniture. In this embodiment, the actuating element 3 is surrounded by four light elements 11 (here: light emitting diodes). The light elements 11 are intended to indicate the position of the switch element 1 to a user.

The switch element 1 can be mounted in place by way of a mounting portion 12.

In this embodiment, the actuating element 3 has two portions 3*a*, 3*b*, the first portion 3*a* being in the form of a pin.

It is further possible to see two switches 6*a*, 6*b* which are disposed on a common circuit board 14 and the function of which will be described in greater detail with reference to FIG. 2.

Figure 1B:
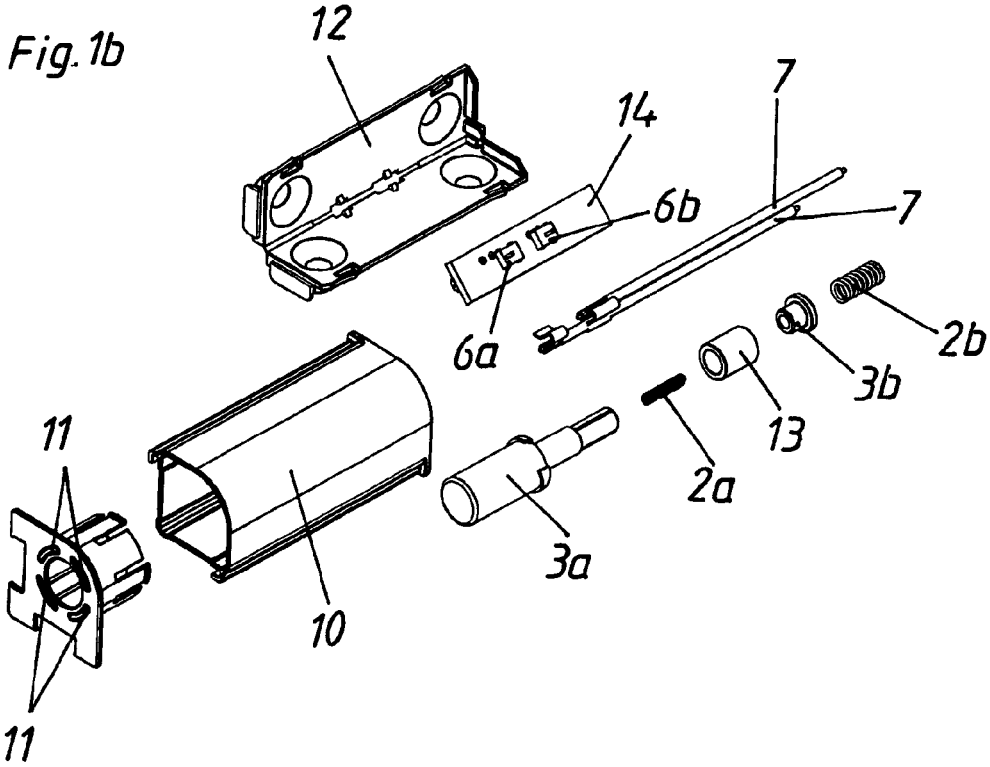
Figure 2B:
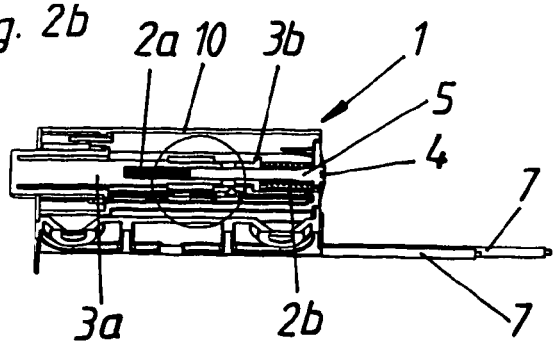
Figure 2B:
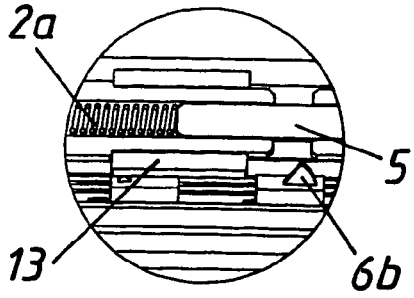
Figure 2A:
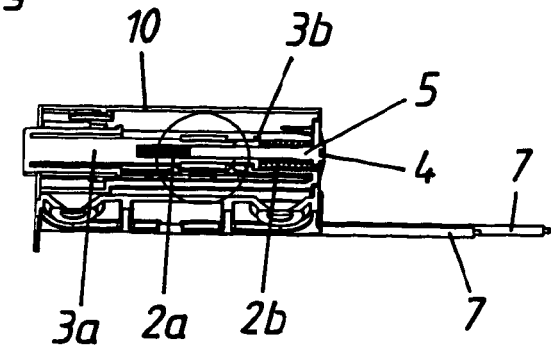
Figure 2A:
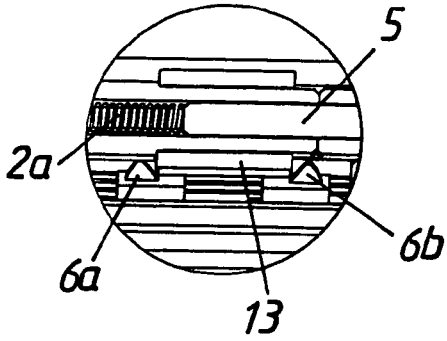

In this respect FIGS. 2*a* through 2*b* show the switch element 1 of FIG. 1 in a sectional view and a detail view in three different operating positions, respectively.

In FIG. 2*a* the switch element 1 is in its neutral position, that is to say a furniture part 8 (not shown) bears against the first portion 3*a* and is in its closed position. The switch element 1 is not activated. It is possible to see in the detail view that connected to the first portion 3*a* is a slider element 13 (here in the form of a sleeve) which is arranged so that, upon a movement of the actuating element 3, it can actuate two switches 6*a*, 6*b*. Upon actuation of a respective one of the two switches 6*a*, 6*b*, there is closure of an electrical contact and transmission of a switching pulse by way of the electric lines 7.

FIG. 2*b* shows the situation where the movable furniture part 8 has been moved out of the closed position somewhat by a user. As a result, it is possible for the first force storage means 2*a* to urge the first portion 3*a* of the actuating element 3 out of the housing 10 to the maximum extent. As can be seen from the detail view, as a result the first switch 6*a* is pushed in by the slider 13 and thus actuated. Consequently, by way of the electric lines 7, a triggering signal is sent to a control or regulating device (not shown) of a drive device and ultimately that results in activation of the drive device for further ejection of the furniture part 8.

Figure 2C:
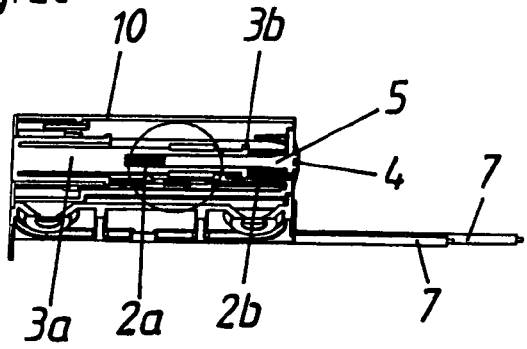
Figure 2C:
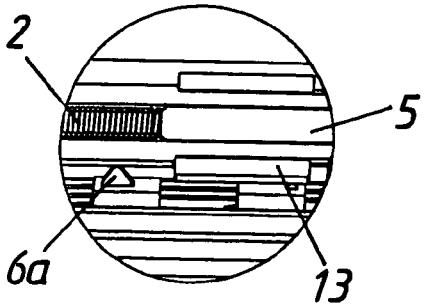

In contrast thereto, in FIG. 2*c* the furniture part 8 has been further pushed into its closed position. The result of this is that the first portion 3*a* fully compresses the first force storage means 2*a* disposed between the first portion 3*a* and a mounting location 5. In that situation, the first portion 3*a* is in contact with the second portion 3*b*, with the second force storage means 2*b* being arranged between the second portion 3*b* and a mounting location 4. In the position shown in FIG. 2*c*, the second portion 3*b* has already been moved somewhat by the first portion 3*a* against the acting force produced by the force storage means 2*b*, and the slider 13 has triggered the second switch 6*b*.

FIG. 2*c* therefore shows the situation in which the actuating element 3 has assumed the position $S_2$ representing a defined switching point. As already stated, that defined switching point is at the transition from the force characteristic curve of the force storage means 2*a* to that of the force storage means 2*b*, as shown in FIG. 6*a*. FIGS. 3 through 5 show a further embodiment of a switch element according to the invention.

As in the first embodiment, the switch element 1 has a housing 10 in which an actuating element 3 is movably mounted. In addition, the signals of the switch element 1 can be passed to a control or regulating device (not shown) by way of electric lines 7 or those lines 7 serve for the power supply to the switch element 1.

Figure 3B:
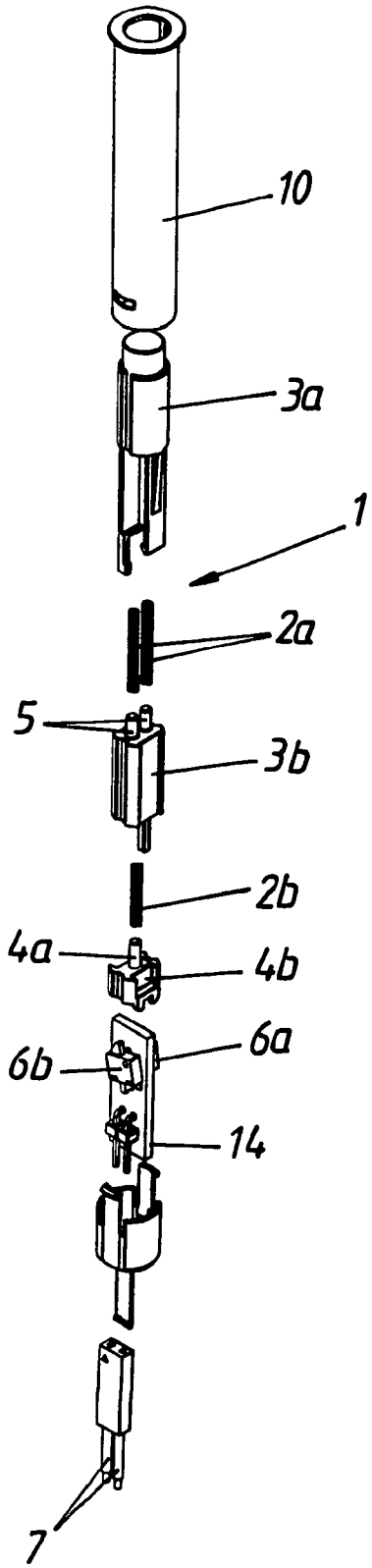
FIGS. 3*a*, 3*b* and 4*a* through 4*c* and 5*a* through 5*d* show a second embodiment of a switch element according to the invention.
Figure 3A:
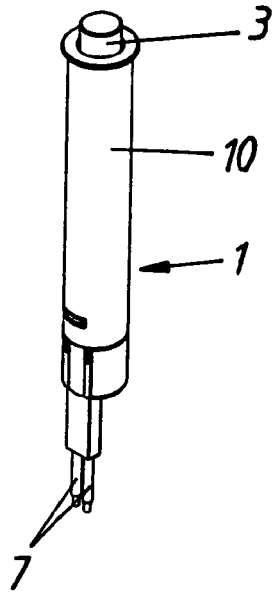

FIG. 3*b* shows an exploded view of the switch element 1.

It will be seen that in this embodiment, the actuating element 3 also has two portions 3*a* and 3*b*. Arranged between the first portion 3*a* and the second portion 3*b* in this case at mounting locations 5 are two first force storage means 2*a* which in total operate like a single force storage means 2*a*. A single second force storage means 2*b* is arranged between the second portion 3*b* and the mounting location 4*a* which is provided on a holder 4*b* fitted on a circuit board 14. Arranged on the board 14 are two switches 6*a*, 6*b* (which in this embodiment are in the form of toggle switches). The function of the switches 6*a*, 6*b* is described in detail with reference to FIGS. 4*a* through 4*c*.

Figure 4B:
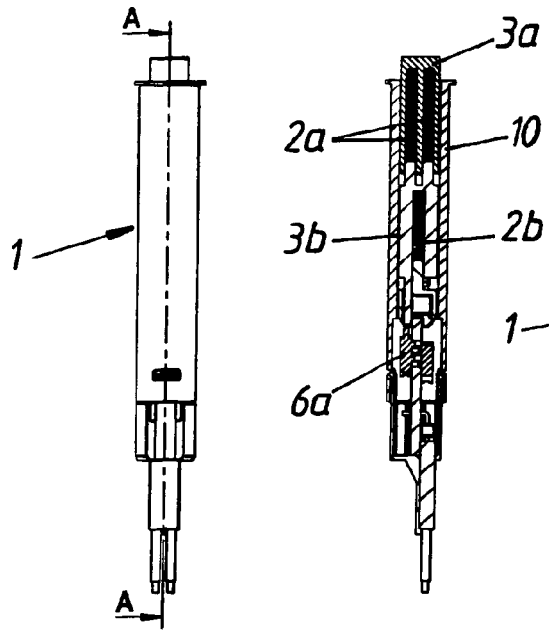
Figure 4C:
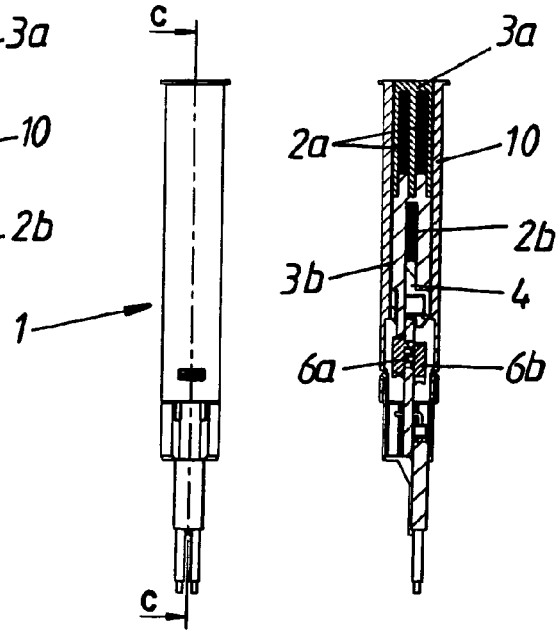
Figure 4A:
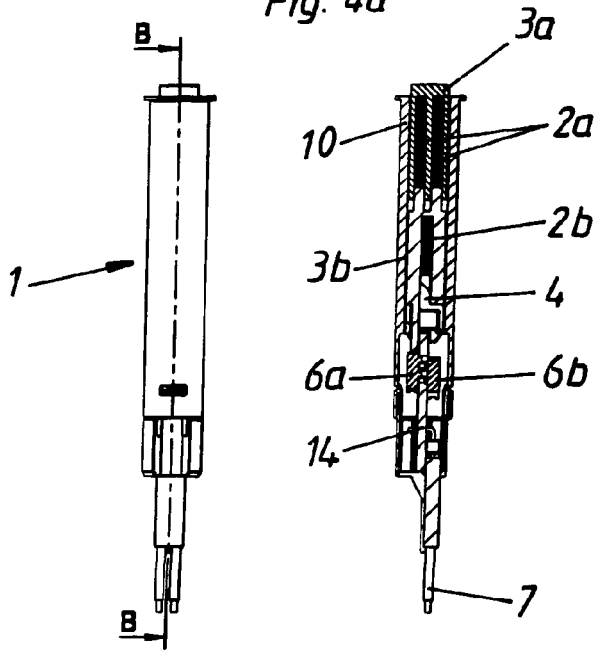

FIG. 4*a* shows the neutral position of the switch element 1 in which the switch element 1 does not emit any signals by way of the lines 7 and the furniture part (not shown) is in the closed position and contacts the first portion 3*a* of the actuating element. In that position, the second portion 3*b* actuates the first switch 6*a*. The force storage means 2*b* between the second portion 3*b* and the mounting location 4*a* is compressed to its maximum, and the second portion 3*b* and the holder 4*b* are butting against each other. As already stated, the situation shown in FIG. 4*a* represents the neutral condition of the switch element 1 although the second portion 3*b* is actuating the first switch 6*a*. That will be more readily understandable by reference to the following Figures.

FIG. 4*b* shows the situation in which the furniture part 8 has been moved somewhat out of the closed position by the user. As a result, the second portion 3*b* and therewith the first portion 3*a* can move out of the housing 10 to the maximum extent under the force applied by the force storage means 2*b*. It will be seen that the second portion 3*b* no longer actuates the first switch 6*a* in that situation. It is precisely that transition from actuation to non-actuation of the first switch 6*a* that supplies the switching pulse which activates the drive device and further ejects the furniture part 8.

FIG. 4*c* shows the situation in which the furniture part 8 was moved further into the furniture body from the closed position by the user. As a result the first portion 3*a* is moved by the maximum into the housing 10 until it bears against the portion 3*b*. That results in maximum compression of the force storage means 2*b* (as in FIG. 4*a*) and further from the position of the first portion 3*a* that is shown in FIG. 4*a*, also leads to compression of the force storage means 2*a* arranged between the first portion 3*a* and the second portion 3*b*. Consequently, not only the first switch 6*a* is activated, which however does not involve any consequences (more specifically that switch 6*a* is in the form of an 'opener'), but also the second switch 6*b* is activated (as a 'closer'), which however cannot be seen from FIG. 4*c*. By virtue of activation of the second switch 6*b*, the drive device is triggered and thus the furniture part 8 is ejected.

The switching operation will be described once again with reference to FIGS. 5*a* through 5*c*.

Figure 5D:
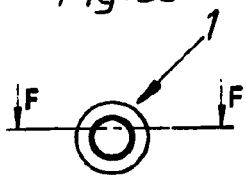
Figure 5D:
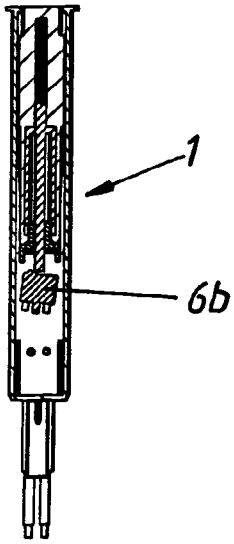
Figure 5B:
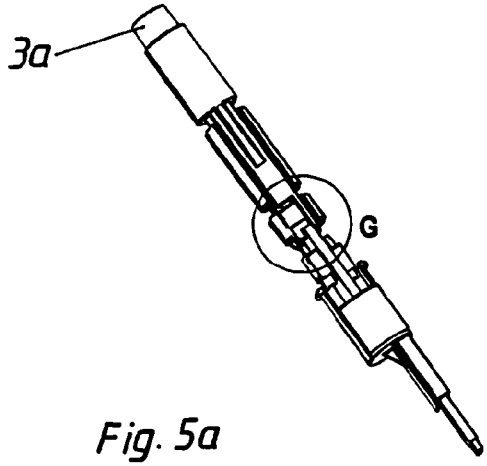
Figure 5A:
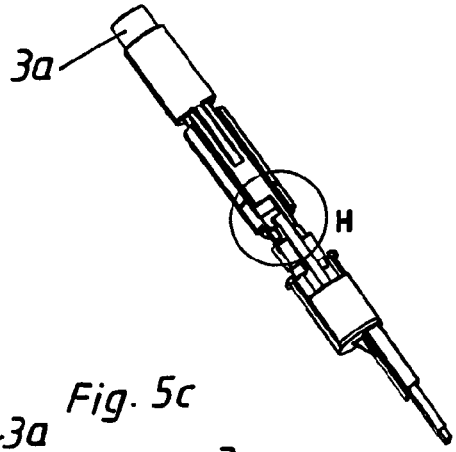

FIG. 5*a* shows the neutral position of the switch element 1, in which respect the housing 10 is not shown here. It will be seen from the enlargement H that in this position the first switch 6*a* is actuated by the second portion 3*b* while the second switch 6*b* is not actuated by the first portion 3*a*.

In FIG. 5*b* the furniture part 8 and therewith the first portion 3*a* and the second portion 3*b* have been moved out. The enlargement G shows that this leads to release of the first switch 6*a* by the second portion 4*b*, which actively switches the switch element 1.

Figure 5C:
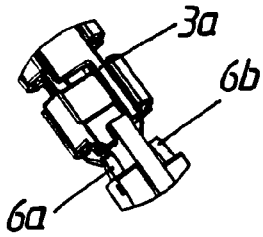
Figure 5C:
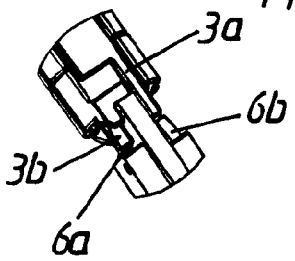
Figure 5C:
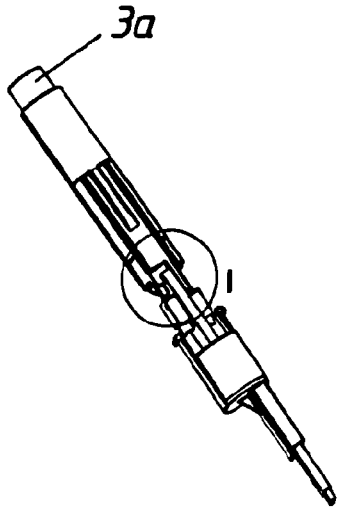
Figure 5C:
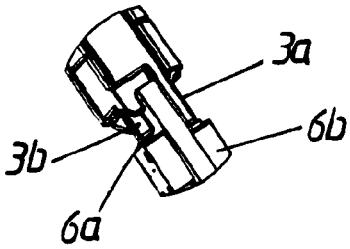

FIG. 5*c* shows the situation when the furniture part 8 is pushed in and with the first portion 3*a* moved to its maximum extent into the housing 10 (not shown). The enlargement I shows that now not only does the second portion 3*b* switch the first switch 6*a* but also the first portion 3*a* switches the second switch 6*b*, which situation is also shown in FIG. 5*d* as a longitudinal section outside the center line of the switch element 1. That also leads to active switching of the switch element 1.

FIGS. 6*a* and 6*b* show two embodiments of the switch element 1, the preferred embodiment 6*a* using two force storage means 2*a*, 2*b* with force characteristic curves $K_1$, $K_2$ of different gradients. In that respect, the force characteristic curve $K_1$ belongs to the force storage means 2*a* and the force characteristic curve $K_2$ belongs to the force storage means 2*b*. It will be seen that only the first force storage means 2*a* acts on the actuating element 3 over the partial travel path between the positions $S_1$ and $S_2$. At the position $S_2$ the force storage means 2*a* is stressed to its maximum (compressed) and the force storage means 2*b* comes into butting relationship. A defined switching point is provided at the position $S_2$ due to the break at the transition from $K_1$ to $K_2$.

A second embodiment is shown in FIG. 6*b*. In this case the characteristic curve $K_2$ has double the gradient of the characteristic curve $K_1$. That is to be attributed to the fact that the characteristic curve $K_1$ is produced only by the action of a single force storage means 2*a* between the positions $S_1$ and $S_2$. That first force storage means 2*a* however is not yet compressed to its maximum at the position $S_2$ but can still exert force. It will be noted, however, that a second force storage means 2*b* of identical nature comes into contacting relationship at position $S_2$ so that, from position $S_2$, the two forces acting on the actuating element 3 are added. Once again at the position $S_2$, a defined switching point is afforded, in which respect it will be noted that in this embodiment 6*b* the definition of the switching point is less well defined by virtue of the less pronounced break (angle between the characteristic curves $K_1$ and $K_2$).

Figure 8A:
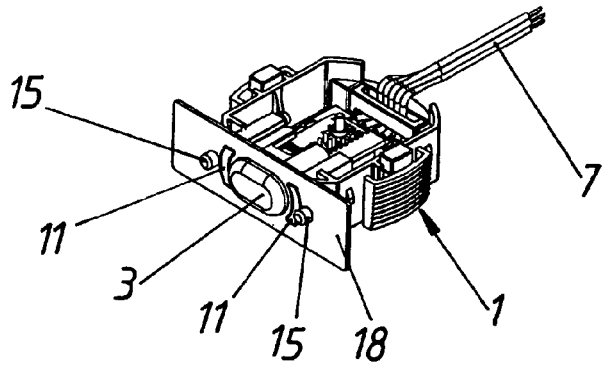
FIGS. 8*a*, 8*b*, 9*a* through 9*c* and 10 show a further variant of a switch element according to the invention.
Figure 9B:
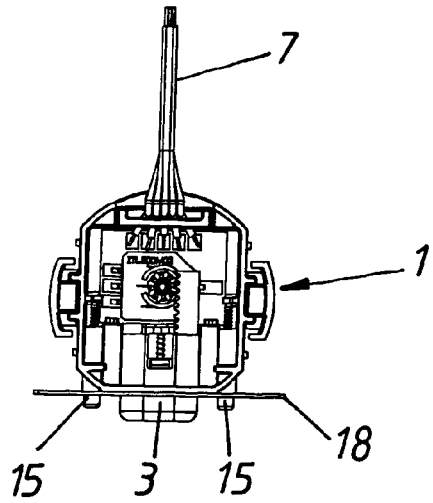
Figure 9A:
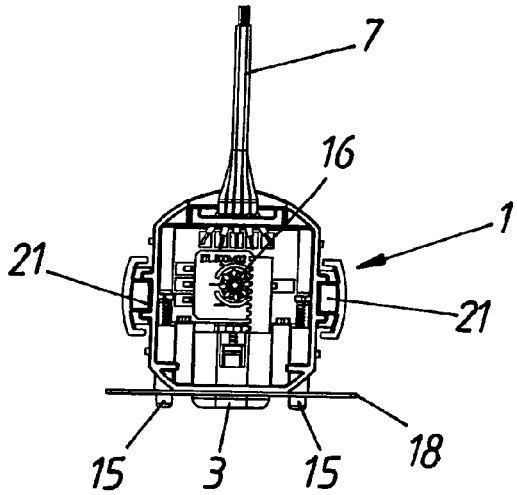
Figure 9C:
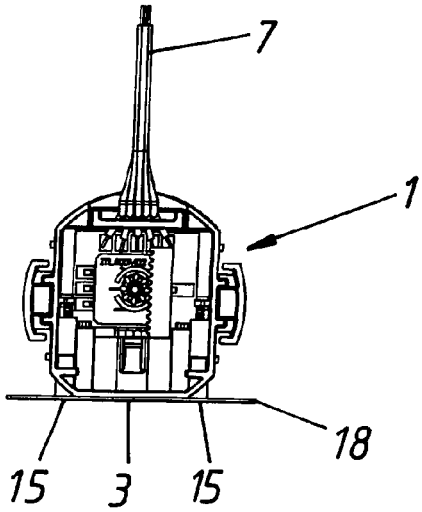
Figure 10:
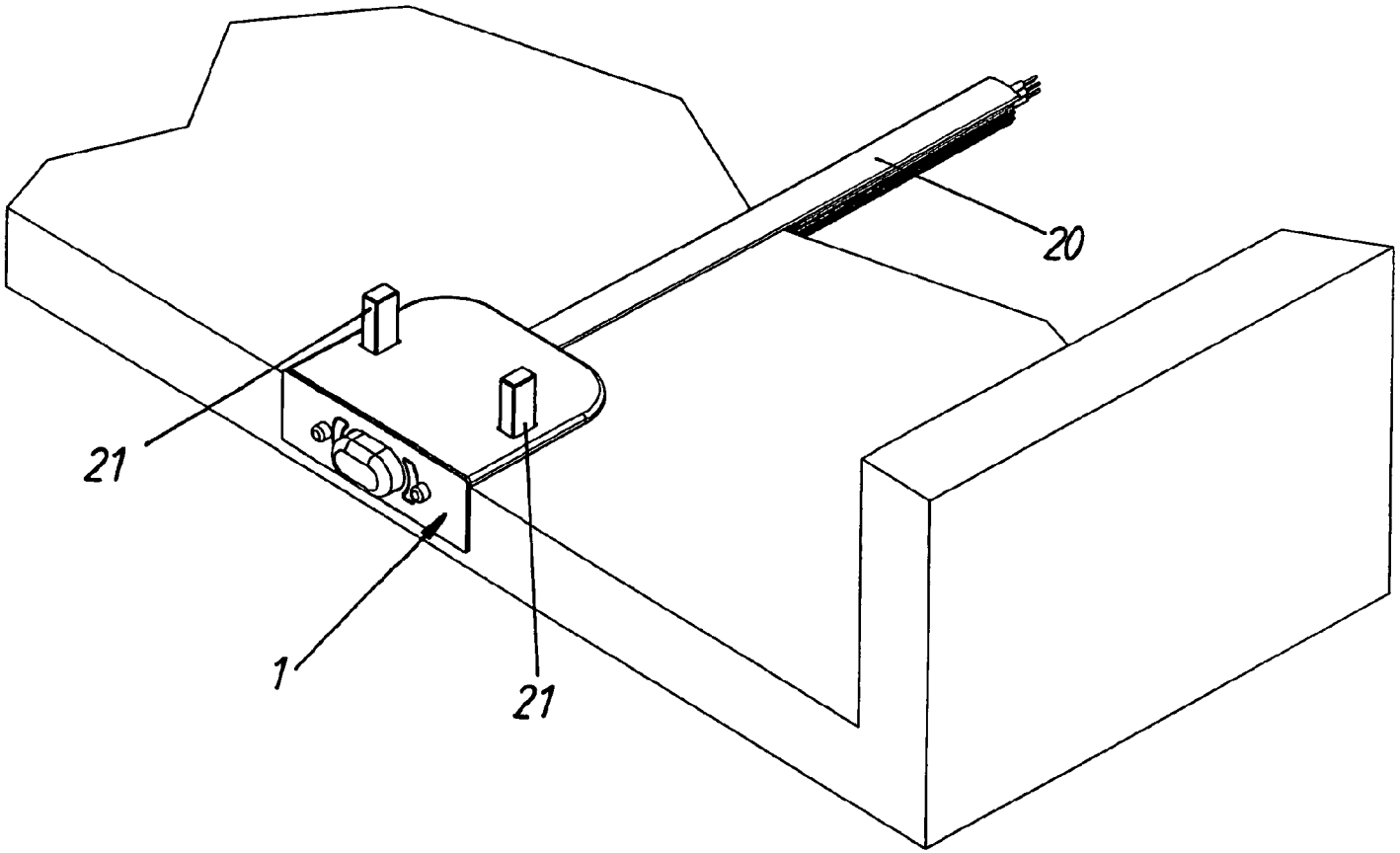

FIGS. 8 through 10 show a further variant of a switch element 1 according to the invention. In this variant the defined switching point is achieved by the provision, separately from the actuating element 3, of at least one further element 15 which is acted upon by at least one force storage means 2*b*. FIG. 8*a* shows an embodiment of such a switch element 1. In this case, provided symmetrically beside the actuating element 3 are two resist elements 15 in the form of pins. It is further possible to see light elements 11.

Figure 8B:
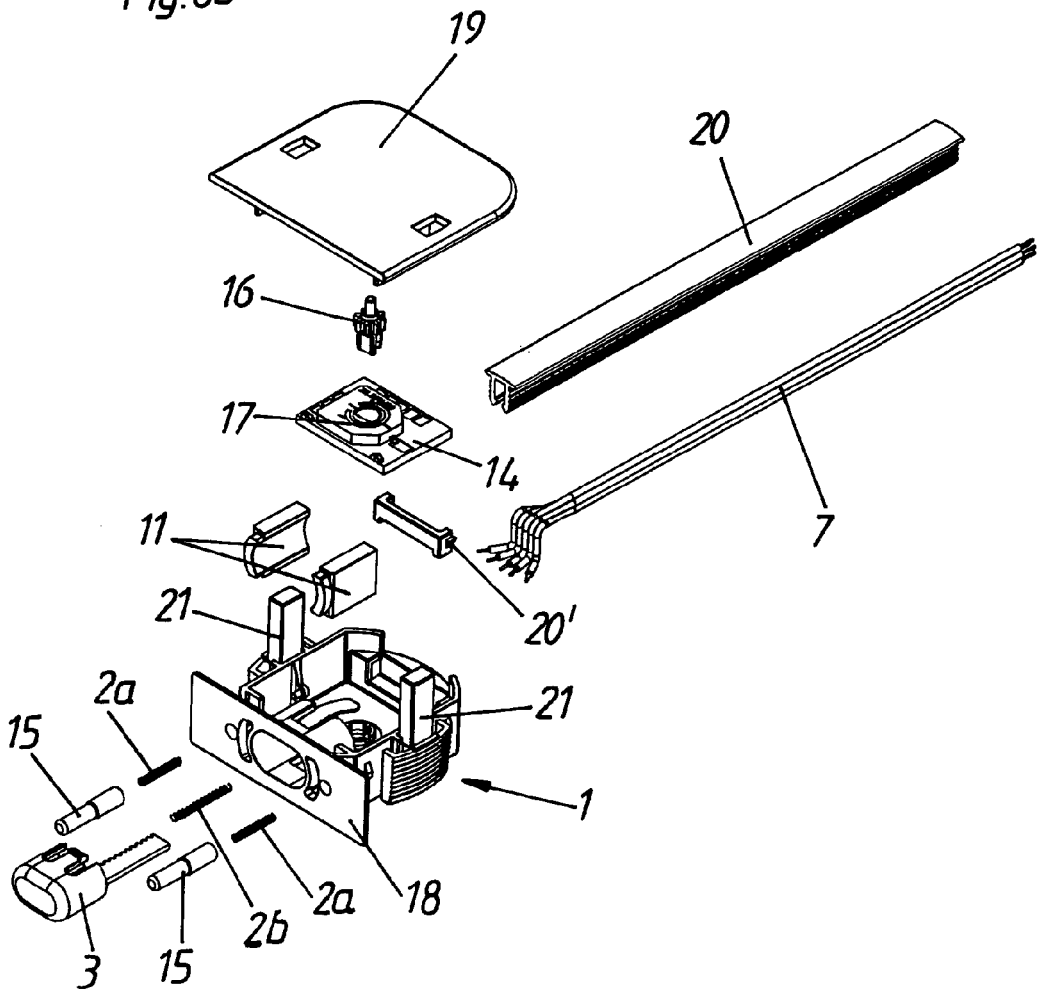

FIG. 8*b* shows an exploded view from which it can be seen that the actuating element 3 has a toothed rack extension meshing with the gear 16 of a potentiometer 17 arranged on a circuit board 14. The potentiometer (movement detection device) 17 serves in that case to detect a movement of the actuating element 3 and to pass it by way of the electric lines 7 to a control or regulating device (not shown) for triggering a drive device. It will be appreciated that the electric lines 7 also serve for the power supply to the switch element 1.

The two resist elements 15 are each acted upon by a respective force storage means 2*a*. In this case, each of the two force storage means 2*a* is shorter than the force storage means 2*b*, with the result that, without the action of a counteracting force, the actuating element 3 projects furthest from the front panel 18 of the switch element 1.

It is further possible to see from FIG. 8 a cover 19, a cable holder 20' and two installation pins 21 serving to fix the switch element 1 in a bore in a furniture body or carcass. The electric lines 7 extend protected in a passage 20 which can be placed in a bore in a furniture body.

The mode of operation of the switch element shown in FIG. 8 will be described with reference to FIGS. 9*a* through 9*c*.

FIG. 9*a* shows the neutral position of the switch element 1 in which it is not active.

In this case a furniture part 8 (not shown) bears both against the actuating element 3 and also against the elements 15. In that way the actuating element 3 is pressed in to such an extent that it lies in a plane with the elements 15.

FIG. 9*b* shows the situation after the furniture part 8 has been moved out by a user. The actuating element 3 can now move away from the front panel 18 to the maximum extent under the action of the force storage means 2*b*. That movement is detected by the potentiometer 17 and leads to triggering of the drive device. In that functionality, the elements 15 play no part.

FIG. 9*c* shows the situation after the furniture part 8 has been pushed into the furniture body to the maximum extent. As a result, both the actuating element 3 and also the elements 15 have moved out of the FIG. 9*a* position into the FIG. 9*c* position. Because the user would have to push both the actuating element 3 and also the elements 15 in against the force applied by the respective force storage means 2*a*, 2*b* in the transition from the FIG. 9*a* position into the FIG. 9*c* position, the user has noted the defined switching point corresponding to the positions shown in FIG. 9*a* of the actuating element 3 and the elements 15.

FIG. 10 shows the switching element 1 in the installed condition in a furniture body, but before the holding pins 21 are pushed in for fixing the switch element 1, The potentiometer can be for example in the form of a linear potentiometer or a rotary potentiometer (as shown in the Figures).

The invention claimed is:

1. A switch element comprising:

an electrical connection to be connected to a control device;

an actuating element mounted so as to be movable along a path;

two switches configured and oriented to be switchable by said actuating element as said actuating element moves along said path, said switches being located along said path and being arranged with respect to said electrical connection so that a signal of each of said two switches is fed to said electrical connection; and at least two force storage devices for acting on said actuating element, at least one of said at least two force storage devices comprising a spring;

wherein said actuating element and said at least two force storage devices are configured so that a quantity of said at least two force storage devices acting on said actuating element changes at predetermined positions along said path such that a gradient of a characteristic curve of a force acting on said actuating element changes at said predetermined positions.

2. The switch element of claim 1, wherein said actuating element has at least two portions mounted so as to be movable relative to each other to a limited extent, a respective one of said at least two force storage devices being arranged between a mounting location and one of said at least two portions.

3. The switch element of claim 1, wherein said at least two force storage devices have force characteristic curves with different gradients.

4. The switch element of claim 1, wherein at least one of said at least two force storage devices is a spring.

5. The switch element of claim 1, wherein at least a portion of said actuating element is formed as a pin.

6. The switch element of claim 1, wherein at least one of said predetermined positions is a switching point.

7. An article of furniture comprising:

a movable furniture part;

a motor for moving said movable furniture part;

a control device for triggering an operation of said motor; and a switch element including:

an electrical connection connected to said control device;

an actuating element mounted so as to be movable along a path;

two switches configured and oriented to be switchable by said actuating element as said actuating element moves along said path, said switches being located along said path and being arranged with respect to said electrical connection so that a signal of each of said two switches is fed to said control device via said electrical connection; and at least two force storage devices for acting on said actuating element, at least one of said at least two force storage devices comprising a spring;

wherein said actuating element and said at least two force storage devices are configured so that a quantity of said at least two force storage devices acting on said actuating element changes at predetermined positions along said path such that a gradient of a characteristic curve of a force acting on said actuating element changes at said predetermined positions.

8. The article of furniture of claim 7, wherein at least one of said predetermined positions is a switching point.

9. The article of furniture of claim 7, wherein said movable furniture part is configured to bear against said actuating element in a closed position of said movable furniture part.

10. The article of furniture of claim 9, wherein said switch element is configured so that a signal of at least one of said two switches is fed to said control device via said electrical connection so as to trigger the operation of said motor when said movable furniture part moves from the closed position away from said actuating element, and when said movable furniture part moves from the closed position toward said actuating element.

11. The article of furniture of claim 7, wherein said switch element is configured so that a signal of at least one of said two switches is fed to said control device via said electrical connection so as to trigger the operation of said motor when said movable furniture part moves from a closed position away from said actuating element, and when said movable furniture part moves from the closed position toward said actuating element.

12. The article of furniture of claim 7, wherein said actuating element has at least two portions mounted so as to be movable relative to each other to a limited extent, a respective one of said at least two force storage devices being arranged between a mounting location and one of said at least two portions.

13. The article of furniture of claim 7, wherein said at least two force storage devices have force characteristic curves with different gradients.

14. The article of furniture of claim 7, wherein at least one of said at least two force storage devices is a spring.

15. The article of furniture of claim 7, wherein at least a portion of said actuating element is formed as a pin.

* * * * *